US009179806B2

(12) United States Patent
Allos

(10) Patent No.: US 9,179,806 B2
(45) Date of Patent: Nov. 10, 2015

(54) BEACH BUCKET

(76) Inventor: Kristian Allos, El Cajon, CA (US)

( * ) Notice: Subject to any disclaimer, the term of this patent is extended or adjusted under 35 U.S.C. 154(b) by 627 days.

(21) Appl. No.: 13/475,162

(22) Filed: May 18, 2012

(65) Prior Publication Data

US 2013/0305449 A1 Nov. 21, 2013

(51) Int. Cl.

| | |
|---|---|
| ***A47K 3/28*** | (2006.01) |
| *B05B 1/24* | (2006.01) |
| *B05B 1/18* | (2006.01) |
| *B05B 9/08* | (2006.01) |

(52) U.S. Cl.

CPC . *A47K 3/288* (2013.01); *B05B 1/18* (2013.01); *B05B 1/24* (2013.01); *B05B 9/0816* (2013.01)

(58) Field of Classification Search

CPC ..... A47K 3/288
USPC ..... 4/602, 603, 615, 616
See application file for complete search history.

(56) References Cited

U.S. PATENT DOCUMENTS

| | | | | |
|---|---|---|---|---|
| 1,742,279 | A | 1/1930 | Reynolds | |
| 4,280,643 | A | 7/1981 | Cordova et al. | |
| 5,390,852 | A | 2/1995 | Schuenemann et al. | |
| 5,528,776 | A | 6/1996 | Carmichael | |
| 5,544,369 | A * | 8/1996 | Roberts | 4/603 |
| 5,678,259 | A | 10/1997 | Cruz Jr. | |
| 5,774,908 | A | 7/1998 | Hall | |
| 5,911,520 | A | 6/1999 | Kenney | |
| 6,302,122 | B1 * | 10/2001 | Parker et al. | 4/603 |
| 6,976,279 | B1 * | 12/2005 | Berke et al. | 4/616 |
| 7,725,974 | B2 | 6/2010 | Hughes | |
| 2005/0086738 | A1 | 4/2005 | Gragtmans | |
| 2006/0200902 | A1 | 9/2006 | Stinchcomb | |
| 2010/0162479 | A1 | 7/2010 | Tai | |
| 2010/0199418 | A1 | 8/2010 | Yi | |

* cited by examiner

*Primary Examiner* — Tuan N Nguyen
(74) *Attorney, Agent, or Firm* — Harness, Dickey & Pierce, P.L.C.

(57) ABSTRACT

An equipment storage device has a container to enable a user to comfortably stand within the container. A reservoir for retaining fluid is coupled with the container. A fluid injection device is coupled with the reservoir. At least one retaining receptacle is positioned on a peripheral wall of the container.

20 Claims, 3 Drawing Sheets

BEACH BUCKET

FIELD

The present disclosure relates to a container and, more particularly, to a combination shower and equipment storage device to retain beach gear or the like.

BACKGROUND

When going to the beach or to surf, it is desirable to have a device to carry the user's gear. Various types of flexible bags and the like have been utilized to carry gear from the user's vehicle to the beach where the activity is to be performed. However, the flexible bags and the like enable sand to be readily picked up and comingled with the gear in the bag.

Beach goers and surfers have also utilized buckets to carry gear. Additionally, they have utilized the bucket to clean off their feet or rinse after their activity. However, the user generally utilizes salt water from the ocean which does not cleanse their wetsuit nor does it provide a clean feel after removal of the wetsuit. Additionally, after the wetsuit has been removed, generally there is no place to store it.

The present disclosure overcomes the disadvantages of the prior devices. The present device provides a user with a storage device that categorizes and retains gear in specific positions. Additionally, the storage device provides a large container that enables the user to store his wetsuit or the like after use. Further, the storage device provides a container to retain the wetsuit after use. Also, the storage device includes an integral self-contained shower to enable the user to utilize fresh water to rinse after their activity. Further, the storage device includes a cover to store the gear in an aesthetically pleasing manner. Additionally, the container includes a drain to enable water sprayed into the container to exit after it has been used by the user.

SUMMARY

According to an object of the disclosure, a storage device comprises a container sized to enable a user to stand comfortably within the container. A reservoir is integrally coupled with the container. The reservoir is adapted to receive a liquid. A device to eject fluid from the reservoir onto the user is coupled with the reservoir. At least one retaining receptacle is positioned on the container to receive gear from the user. A cover is coupled with the container. A drain is positioned in the bottom of the container. A mechanism for heating a liquid is coupled with the reservoir. The reservoir and container are of a one piece unitary construction. The receptacles are positioned on the external peripheral wall of the container. The receptacles are unitarily formed with the peripheral wall of the container. A hanging device for the fluid ejection device is coupled with the container. Waterproof speakers with electrical jacks are present for attachment to smartphones, MP3 players or the like.

According to an additional aspect of the disclosure, a locker comprises a container with an extending peripheral wall. The container enables a user to comfortably stand in the container. A liquid reservoir is coupled with the container. A shower mechanism is coupled with the reservoir to eject fluid from the reservoir onto the user. A plurality of pockets is coupled with the peripheral wall of the container. The pockets enable retention of wax, fins, leashes or the like. The container includes a unitarily formed drain. A solar panel may be coupled with the reservoir to heat liquid in the reservoir. The shower mechanism includes a pump and a hose to eject the fluid from the reservoir. A cover covers the container. Wheels may be coupled with the container to enable mobility of the container. The pockets may be a one piece design with the peripheral wall of the container. The container has an overall rectangular configuration with the peripheral wall having a height of about 2-4 feet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
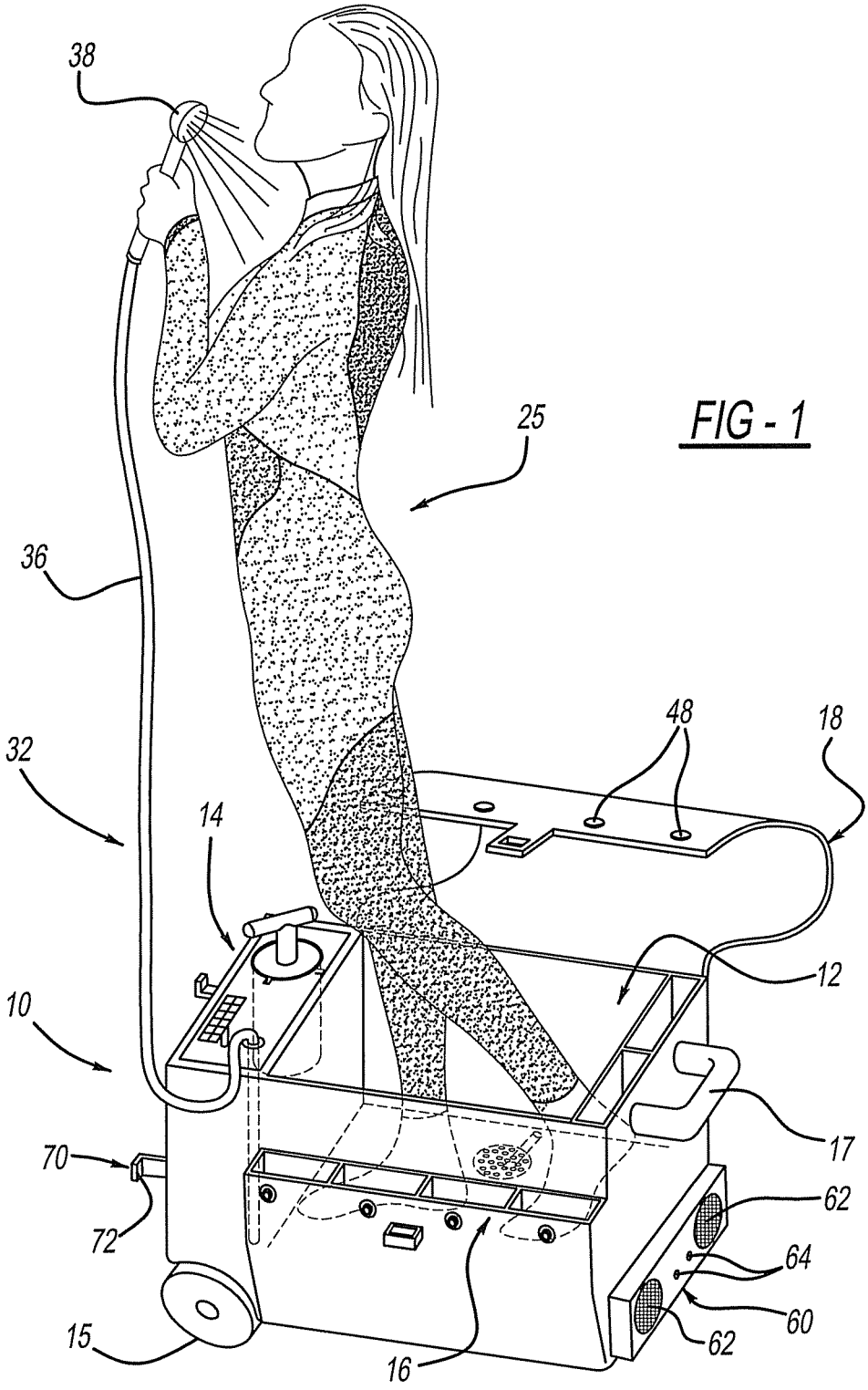
FIG. 1 is a perspective view of the equipment storage device.
Figure 2:
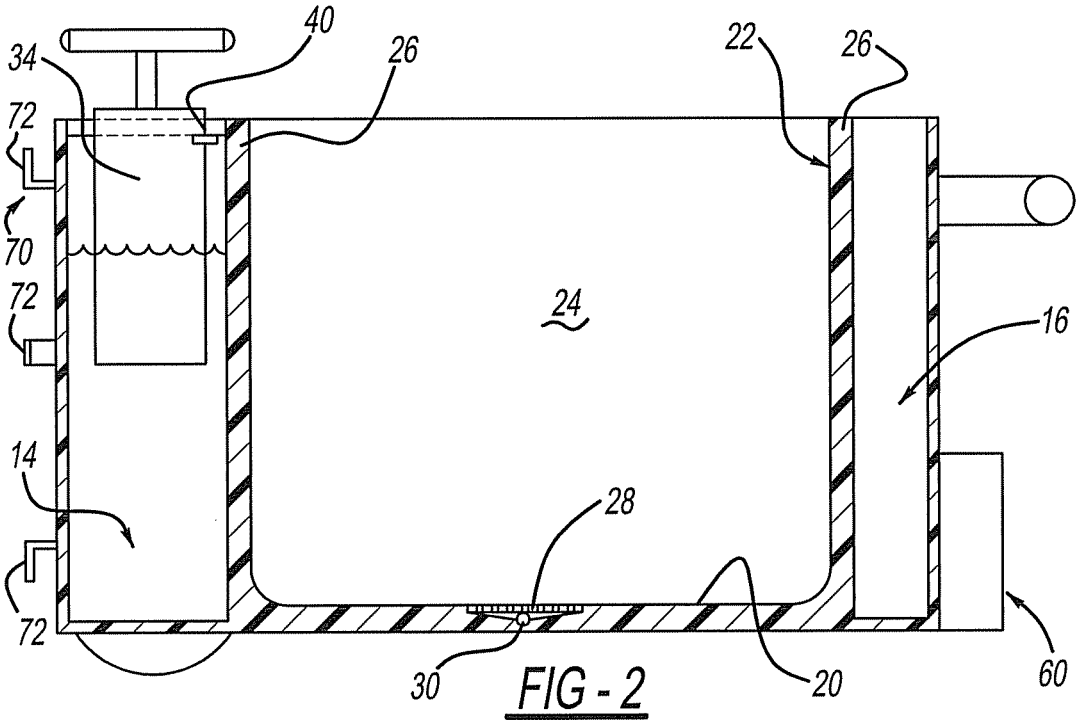
FIG. 2 is a cross-sectional view of FIG. 1 along line 2-2.
Figure 3:
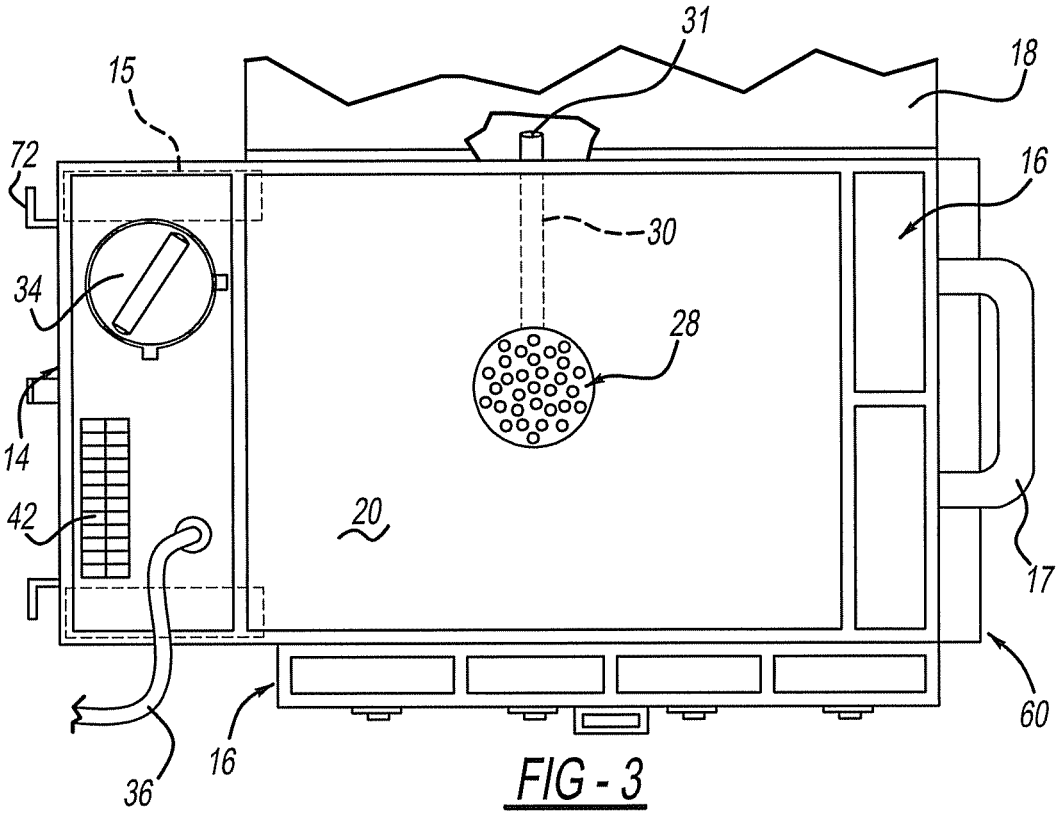
FIG. 3 is a top plan view of FIG. 1.
Figure 4:
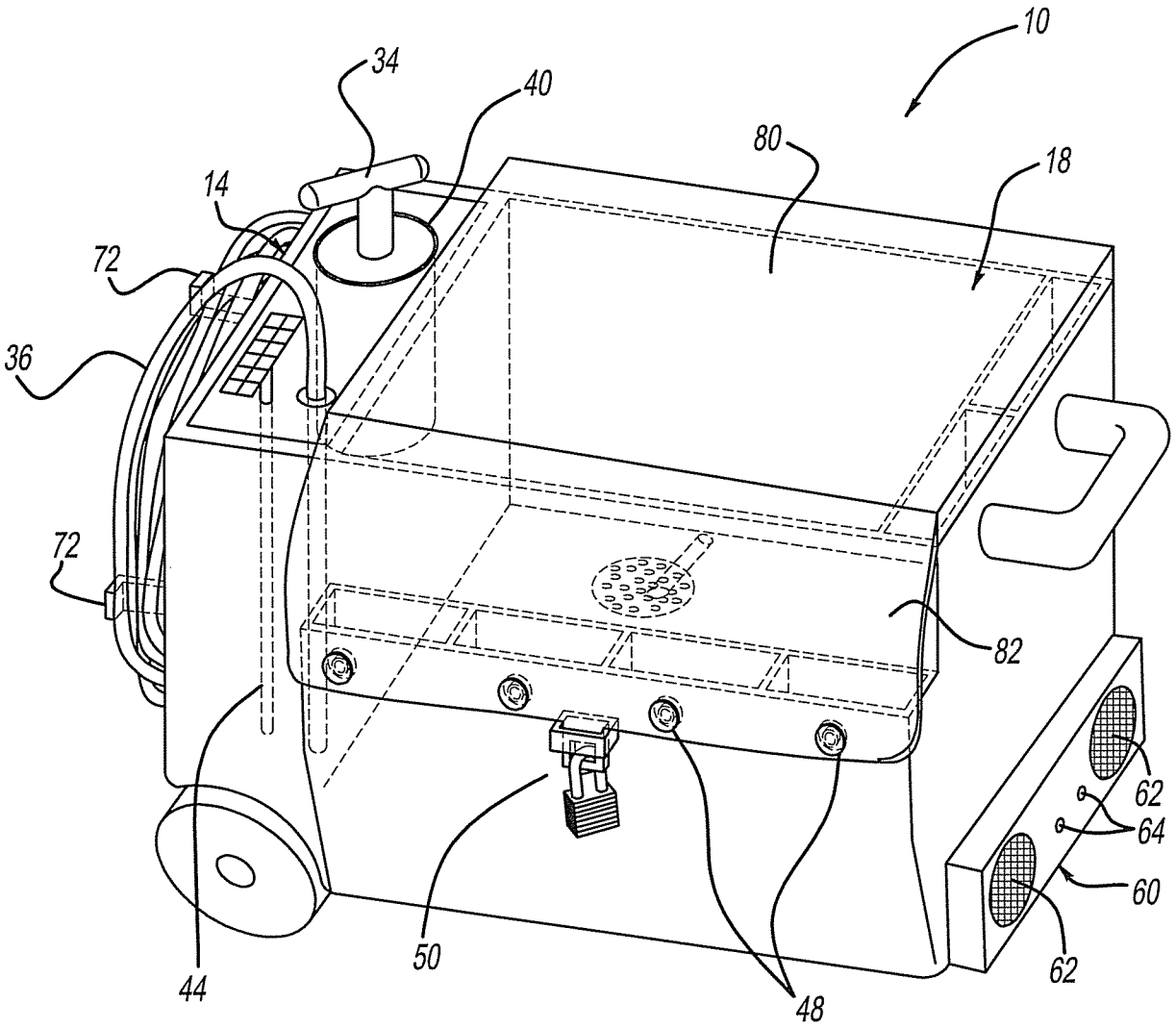
FIG. 4 is a perspective view of the equipment storage device with the cover in a secured position.

Example embodiments will now be described more fully with reference to the accompanying drawings.

Turning to the figures, an equipment storage device is illustrated and designated with the reference numeral 10. The storage device includes a container 12 with an integrally reservoir 14 and receptacles 16. A cover 18 is coupled with the container to prohibit access inside the container 12 and receptacles 16. Wheels 15 and a handle 17 may be coupled with the container 12.

The container 12 has an overall rectangular shape with a bottom 20 and a peripheral wall 22. The bottom 20 and peripheral wall 22 could include insulative material, if desired. The peripheral wall 22 includes a major sidewall 24 and minor sidewalls 26. The peripheral wall generally has a height of at least 18 inches. However, it could be from 2 to 4 feet. The major sidewall 24 have a length of about two feet, however, they could be larger or smaller depending on design. The minor sidewalls 26 have a length of about 18 inches and thus generally have an overall square configuration. Additionally, they could be 2 to 4 feet. The bottom 20 has an overall rectangular shape with a width of at least 18 inches and a length of 24 inches. This provides a large area for a user 25 to comfortably stand in when the user is rinsing after his activity. The bottom 20 includes a drain 28. The drain 28 is below the surface of the bottom 20. A grate 29 may cover the drain 28. The drain 28 includes a bore 30 that enables the drain 28 to enable fluid to exit from inside the container 12 to outside of the container 12. Generally, the bore 30 is unitarily formed in the bottom 20; however, a hose or the like could be used. Additionally, a plug 31 or the like could be utilized in the bore if it is desirable to utilize the container to retain fluid.

The reservoir 14 is generally unitarily formed with a minor sidewall 26 of the container 12. The reservoir 14 generally has an overall rectangular configuration to hold a fluid such as water to enable the surfer to rinse after surfing. The reservoir generally includes a showering mechanism 32 coupled with the reservoir. The showering mechanism 32 generally includes a pump 34 and a hose 36 with a head 38. The pump 34 is removable from the reservoir 14 providing an aperture 40 in the reservoir. The aperture 40 in the reservoir 14 enables the reservoir 14 to be filled with fluid. The pump 34 is generally a manual type where the pump 34 is manually pushed up and down to create pressure in the reservoir 14 which, in turn, enables pressurized fluid to exit through the hose 36 and out the head 38 onto the user 25 in the container 12. Thus, the user 25 may shower after beach activity, such as surfing, disrobe from her wetsuit, and utilize fresh water to clean the user 25 as well as the wetsuit.

A solar panel 42 may be coupled with the reservoir 14. The solar panel 42 may include a heating element 44 positioned in the fluid inside of the reservoir 14. Thus, as the storage device 10 sits out in the sun while the beach activity is conducted, the water inside the reservoir 14 may be heated so that when the user is finished, he may take a warm rinse to clean off his wetsuit as well as himself.

Also, the reservoir 14 may include a hose hanger 70. The hose hanger 70 includes a plurality (four are shown) of hooks 72. The hooks 72 are L-shaped and enable the hose 36 to be wrapped to provide a pleasing aesthetic appearance.

The external surface of the peripheral wall 22 includes the receptacles 16. The receptacles 16 are generally unitarily formed with the peripheral wall 22. The receptacles 16 may be divided into a number of receptacles to receive surfing gear. The receptacles 16 on the major sidewall 24 of the peripheral wall 22 may be utilized to store wax or the like. Generally, the major sidewall 24 includes three to four unitarily formed receptacles 16. The minor sidewall 26 of the container 12 may include a pair of receptacles 16. The receptacles generally extend the entire height of the container. Thus, the receptacle 16 or pockets may be used to receive fins, leashes or the like.

A speaker assembly 60 may be associated with the minor sidewall 26. The speaker assembly 60 includes a pair of waterproof speakers 62, 62, as well as jacks 64 to connect with smartphones, MP3 players and the like.

The cover 18 may include snaps 48 or the like to secure the cover onto the container 12. When the cover 18 is pulled over the container to deny access, the cover additionally covers the receptacles or pockets 16 to prohibit entry into the pockets 16. The cover 18 could be fitted with a locking device 50 so that unauthorized entry into the storage device 10 is prohibited. Alternatively, a lid portion 80 of the cover 18, covering the container, is a sturdy rigid planar lid for providing a sitting area on top of the container 12 (see FIG. 14). Also, a flexible portion 82 extends from the lid 80 to attach with the locking device 50.

While the container 12 is illustrated with a peripheral wall and a unitary reservoir and receptacles or pockets, it is understood that the reservoir as well as the receptacles or pockets could be attached to and removable from the container 12. Additionally, the receptacles and reservoir could be manufactured from a fabric type of material and coupled with the container 12.

Additionally, the equipment storage device 10 may also be used for storage of sand toys and for showering of children while at the beach.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. An equipment storage device comprising:

a container having a bottom with a peripheral wall defining sides of the container and extending from the bottom defining an interior space enabling a user to stand within the interior space defined between the peripheral wall and bottom of the container;

a reservoir integrally coupled with the container, the reservoir adapted to receive a liquid;

a device for ejecting liquid from the reservoir onto the user in the container; and at least one retaining receptacle positioned outside of the interior space and integrally formed with one of the sides of the peripheral wall on the container for receiving gear of the user.

2. The equipment storage device of claim 1, further comprising a cover spanning a periphery of the peripheral wall for covering the space defined between the peripheral wall and the bottom of the container such that the cover encloses the interior space to prohibit entry into the interior space.

3. The equipment storage device of claim 1, further comprising a mechanism for heating the liquid in the reservoir.

4. The equipment storage device of claim 1, wherein the reservoir and container are of a one piece construction.

5. The equipment storage device of claim 1, wherein the container peripheral wall and bottom are insulated.

6. The equipment storage device of claim 5, wherein the at least one retaining receptacle is on an external side of the peripheral wall.

7. The equipment storage device of claim 6, wherein a plurality of retaining receptacles are coupled with the peripheral wall.

8. The equipment storage device of claim 7, wherein the plurality of retaining receptacles are unitarily formed with the peripheral wall.

9. The equipment storage device of claim 1, wherein a speaker assembly is coupled with the peripheral wall.

10. The storage device of claim 1 further comprising a drain in the bottom of the container.

11. The storage device of claim 1, further comprising a hanging device.

12. The storage device of claim 1, further comprising a cover spanning the peripheral wall with a seating area.

13. A beach locker comprising:

a container with a bottom and an extending peripheral wall defining an interior space and defining sides of the container, the container enabling a user to comfortably stand within the interior space defined by the bottom and extending peripheral wall of the container;

a liquid reservoir coupled with the container;

a shower mechanism coupled with the reservoir for ejecting fluid from the reservoir; and a plurality of pockets positioned outside of the interior space and integrally formed with one of the sides of the peripheral wall, wherein the plurality of pockets coupled with the peripheral wall for retaining gear used by the beach goer.

14. The beach locker of claim 13, further comprising a solar panel coupled with the reservoir for heating liquid in the reservoir.

15. The beach locker of claim 13, wherein the shower mechanism includes a pump and a hose for ejecting fluid from the reservoir.

16. The beach locker of claim 13, further comprising a cover spanning a periphery of the peripheral wall for covering the space between the bottom and peripheral wall of the container such that the cover encloses the interior space to prohibit entry into the interior space.

17. The beach locker of claim 13, further comprising wheels coupled with the basin.

18. The beach locker of claim 13, wherein at least three pockets are on the peripheral wall.

19. The beach locker of claim 13, wherein the container, peripheral wall, reservoir and at least one pocket are of a one piece design.

20. The beach locker of claim 13, wherein the container has an overall rectangular configuration with the peripheral wall having a height of about 2-4 feet.

* * * * *